US005834677A

United States Patent [19]

Muller

[11] Patent Number: 5,834,677

[45] Date of Patent: Nov. 10, 1998

[54] STABILIZING DEVICE FOR A SMALL FIRE ARM

[75] Inventor: Sylvain Muller, Maurepas, France

[73] Assignee: Giat Industries, France

[21] Appl. No.: 776,814

[22] PCT Filed: Jul. 19, 1996

[86] PCT No.: PCT/FR96/01145

§ 371 Date: Feb. 7, 1997

§ 102(e) Date: Feb. 7, 1997

[87] PCT Pub. No.: WO97/04282

PCT Pub. Date: Feb. 6, 1997

[30] Foreign Application Priority Data

Jul. 20, 1995 [FR] France ..... 95 08811

[51] Int. Cl.[6] ..... F41G 3/08

[52] U.S. Cl. ..... 89/41.17; 89/41.06

[58] Field of Search ..... 89/41.17, 41.19, 89/41.06, 41.02, 41.09, 41.15, 41.16

[56] References Cited

U.S. PATENT DOCUMENTS

| | | | |
|---|---|---|---|
| 3,566,743 | 3/1971 | Frohock, Jr. | 89/41.06 |
| 3,711,204 | 1/1973 | Steck, III | 33/234 |
| 4,393,597 | 7/1983 | Picard et al. | 33/236 |
| 5,171,933 | 12/1992 | Eldering | 89/41.06 |
| 5,408,778 | 4/1995 | Goodwin et al. | 89/41.19 |

FOREIGN PATENT DOCUMENTS

| | | |
|---|---|---|
| 2699658 | 6/1994 | France . |
| 3808804 | 8/1991 | Germany . |

*Primary Examiner*—Stephen M. Johnson
*Attorney, Agent, or Firm*—Parkhurst & Wendel

[57] ABSTRACT

A stabilizing device for a small fire arm comprising means (12) to uncouple the cannon with respect to the firer, hinged linking means (14) which are mounted between the cannon (5) and the uncoupling means (12) to enable the cannon (5) to swivel with respect to the uncoupling means (12), and means (15) to control the swivelling of the cannon (5) in order to offset parasitic movements imparted to the fire arm by the firer during sighting thus holding the cannon (5) in the line of sight fixed by the firer.

11 Claims, 3 Drawing Sheets

STABILIZING DEVICE FOR A SMALL FIRE ARM

BACKGROUND OF THE INVENTION

1. Field of the Invention

The technical scope of the present invention is that of stabilizing means applicable to small firearms.

2. Description of the Prior Art

Any small personal firearm is held and pointed at its target by the hands of the shooter who aims it in the direction of fire with the aid of a sighting device which is usually integral with the barrel. When the firearm is fitted with a sighting device, the line of sight is delimited by a cross-hair or other optical reference mark.

When the shooter judges that the sights are in line with the target, he triggers the shot. At the present time, all small firearms operate according to this principle.

However, this way of proceeding causes two main drawbacks during firing to which no solutions have yet been found. First of all, the inevitable quavering of the shooter's hand prevents, even for an experienced shooter, accurate aiming on the target because of the constant movement of the line of sight and thus of the aim. Then, on firing, that is when the shooter presses the trigger, a slight de-aiming occurs. These, even almost imperceptible, movements directly result in a drop in the hit probability which is inevitable given this way of proceeding. This can be compared with results obtained by firing from the same weapon mounted on a rest, that is where there is no inadvertent movement of the weapon at the instant of firing, the result obtained being fully satisfactory in terms of probability. However, firing carried out by a shooter leads to a quasi nil hit probability for an aiming error of around 3 mrd.

A solution to meet this drawback has already been proposed which is based on the principle of controlling a firing window, but this type of solution is complicated. Thus, we know of an electric firing system using gyrometric data filtering, an electric firing system based on image processing and gap measuring, and an image stabilizing system, for example of a video image, with electrical firing.

In these systems, the fact that the firearm is subjected to erratic movements is utilized and the shot is triggered when the line of sight of the barrel is judged to be the most accurate. But, for all these systems, drawbacks remain. In fact, it is essential for the erratic movement of the firearm to pass over the target to trigger firing. Thereafter, a range finder is often used which in turn must be stabilized in order to operate correctly.

SUMMARY OF THE INVENTION

The aim of the invention is to propose a stabilizing system which offers a good hit probability and which enables the firing operations to be simplified, thereby avoiding the aforementioned drawbacks.

To this end, the invention proposes a stabilizing device for a small firearm comprising a sighting device which is characterised in that it comprises means to uncouple the barrel with respect to the shooter, hinged linking means which are mounted between the barrel and the uncoupling means to enable the barrel to swivel with respect to the uncoupling means. Means to control the swivelling of the barrel are provided in order to offset parasitic movements imparted to the firearm by the shooter during sighting thus keeping the barrel in the line of sight fixed by the shooter.

According to a preferred embodiment, the means to uncouple the barrel from the firer are formed of a tubular element which is coaxially brought around the barrel and is integral with the body of the firearm being handled by the firer.

Generally speaking, the linking means mounted between the uncoupling means and the barrel comprise two axes which are perpendicular to one another and onto which the barrel is mounted hinged.

By way of example, the linking means are formed of a system of the universal joint or ball type.

As a variant, these linking means can be formed of four wire assemblies working by elastic torsion, two wire assemblies being located respectively on either side of the barrel and aligned with one of the axes of the barrel, and the two other wire assemblies also being located on either side of the barrel and aligned with the other pivotal axis of the barrel.

Generally speaking, the control means which make the barrel swivel around and which offset the parasitic movements imparted to the firearm by the shooter during sighting comprise a servo system which is formed by:

- control electronics which emit control signals from instructions supplied by two sensors which are integral with the body of the firearm and which detect parasitic angular movements of the arm around the two axes of the barrel,
- two actuators driven by the signals emitted by the control electronics to make the barrel swivel around in order to offset the parasitic angular movements of the arm, and
- two position and/or frequency sensors carried by the barrel and which emit signals corresponding to the actual position and/or frequency of movement of the barrel and which are transmitted to the control electronics to enable the control signals transmitted to the actuators to be to be monitored and thus keeping the barrel in line with the line of sight fixed by the shooter.

According to one embodiment of the invention, the hinged linking means which enable the barrel to swivel around are located towards the rear of the barrel, whereas the two actuators which control the swivelling of the barrel are located to the front of the latter, the linking means and the two actuators also act as support means for the barrel.

Each actuator is, for example, formed by a torque motor or back-geared motor which drives a cam resting against the barrel, and by an elastic return means opposed to the cam, thus holding the barrel in line with the target.

As a variant, each actuator can be formed of an actuating drive, an electromagnet or a piezoelectric device.

The fact of stabilizing the barrel with respect to the firer offers the notable advantage of being able to make the barrel integral with a sighting and rangefinding device to ensure high quality target spotting, identification and tracking, as well as the accurate orienting of the rangefinding direction.

Other characteristics and advantages of the invention will become apparent from reading the additional description given hereafter in relation to the accompanying drawings.

Figure 1:
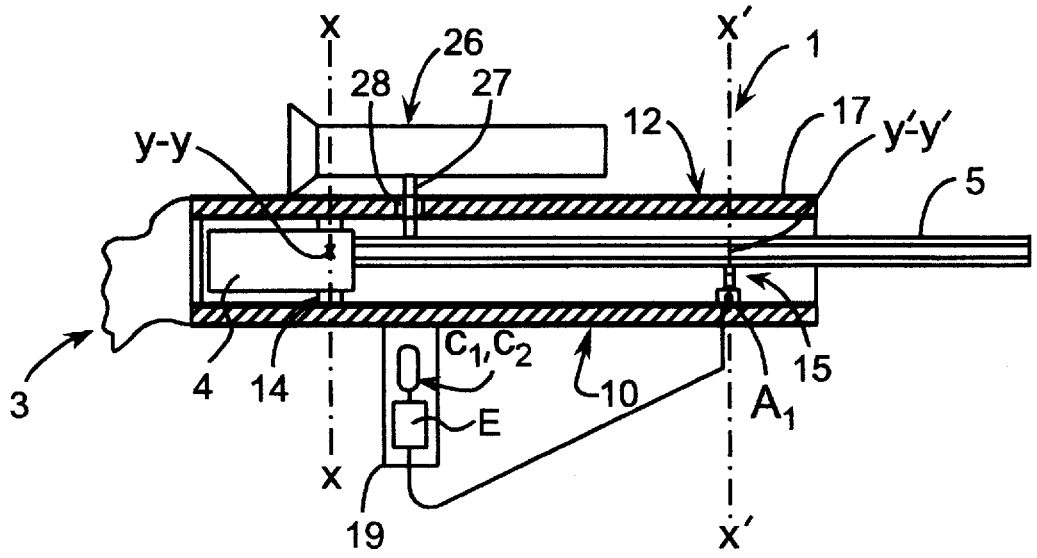
FIG. 1 schematically represents a firearm fitted with the stabilizing device in accordance with the invention.

The small personal weapon 1 illustrated in FIG. 1 comprises a partially shown body 1 which supports all the operative mechanisms of the weapon, a loading and firing chamber 4 extended by a cannon.

The barrel 5 is combined with a stabilizing device 10 which comprises means 12 to uncouple the barrel 5 with respect to the firer who is handling the weapon 1, hinged linking means 14 which are mounted between the barrel 5 and the uncoupling means 12 to enable the barrel 5 to swivel with respect to the uncoupling means 12, and means 15 to control the swivelling of the barrel 5 in order to offset the parasitic movements imparted to the weapon 1 by the shooter during sighting and thus keep the barrel 5 in line with the line of sight fixed by the shooter.

The means 12 to uncouple the barrel 5 with respect to the firer are formed by a tubular element 17 which is coaxially brought around the barrel 5 and is integral with the body 3 of the weapon 1.

The hinged linking means 14 mounted between the tubular element 17 and the barrel are intended to enable the barrel 5 to swivel around following two pivotal axes X—X, Y—Y which are perpendicular to one another. These hinged linking means 14 are located towards the rear of the barrel 5 and are of the universal joint or ball type.

Figure 2:
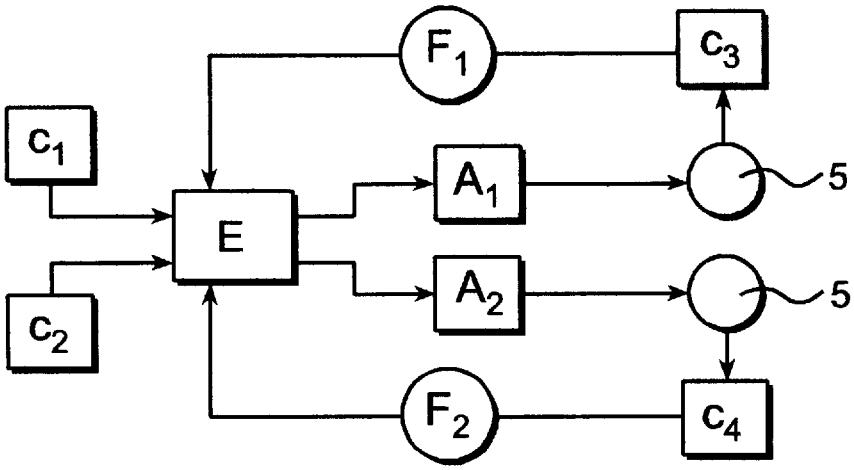
FIG. 2 is a block diagram which illustrates the servo system combined with the stabilizing device, FIG. 3 schematically illustrates one embodiment of the hinged linking means which enable the barrel to swivel around following two axes which are perpendicular to each other.

With reference to FIG. 2, the means to control the swivelling of the cannon 5 with respect to the tubular element 17 comprise a servo system which is formed by

- control electronics E which deliver control signals from instructions supplied by two sensors C1 and C2 which are integral with the body 3 of the weapon and which detect angular parasitic movements of the weapon around the two pivotal axes X—X, Y—Y of the barrel 5,
- two actuators A1 and A2 driven by the signals issued by the control electronics E to make the barrel 5 swivel around, and
- two position and/or frequency sensors C3 and C4 which are carried by the barrel 5 and which emit signals corresponding to the actual position and/or frequency of movement of the barrel 5 and which are transmitted to the control electronics E to enable the control signals transmitted to the actuators A1 and A2 to be monitored and thus keep the barrel 5 in line with the line of sight fixed by the shooter.

The two sensors C1 and C2 are of the gyrometric type and are carried by a plate 19 integral with the tubular element 17.

The control electronics E, also supported by the plate 19, notably comprise two filters which respectively receive the instructions transmitted by sensors C1 and C2 in order to deliver as output the control signals for the two actuators A1 and A2.

The two instructions are respectively sent to the two actuators A1 and A2 to make the barrel 5 swivel around following the two pivotal axes X—X and Y—Y.

The two actuators A1 and A2 are located towards the front of the barrel 5 and are mounted between the barrel 5 and the tubular element 17 being arranged along two axes parallel to the pivotal axes X'—X', Y'—Y'.

Figure 4:
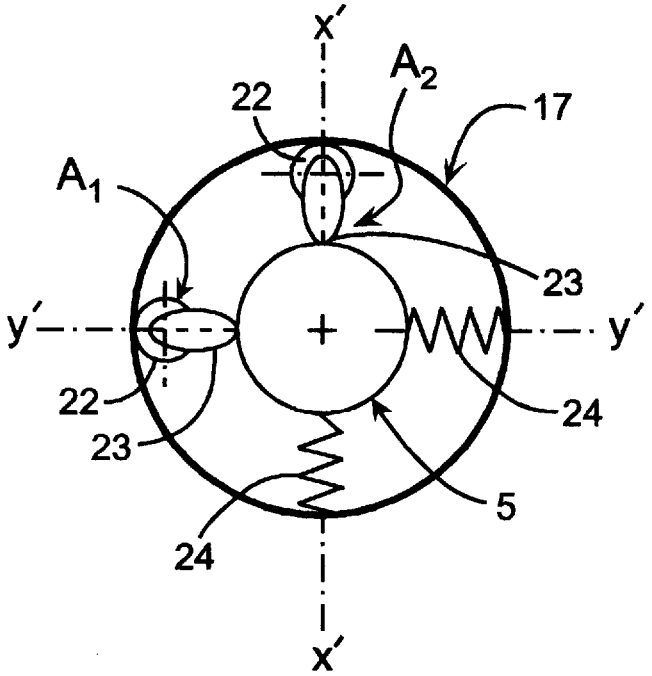
FIGS. 4 and 5 illustrate two embodiments of the control means which enable the barrel to be swivelled around on X'—X', Y'—Y' axes.

According to the embodiment illustrated in FIG. 4, the actuator A1 is formed by a torque motor 22 or back-geared motor which drives a cam 23 which comes to rest on the barrel 5 and by an elastic return means 24, such as a spring, to hold the cam against the barrel 5. The torque motor is a known electric motor producing a strong torque with no back gearing. The structure of actuator A2 is identical to that of actuator A1.

The stabilizing device operates as follows.

The control instructions are formulated with the aid of the two sensors C1 and C2 which measure the angular parasitic movements of the body 3 of the weapon around the two pivotal axes X—X, Y—Y of the cannon 5. After filtering the control instructions, the control electronics E drive the two actuators A1 and A2 to cause the barrel 5 to swivel around in order to offset the parasitic movements imparted to the weapon 1 by the firer.

Another servo solution consists in putting angular frequency sensors on the barrel, sensors C3 and C4. In this configuration, sensors C1 and C2 are eliminated. At the beginning of the firing sequence the firer sights his targets with the aid of the sighting device 26: he fixes the cross-hair on the target. If he wishes, the shooter can trigger the stabilizing device (for example, by using a push button placed on the plate 19). From then on, the stabilizing device becomes active, that is:

- sensors C3 and C4 measure the angular movements of the barrel with respect to the ground reference and are filtered (high-pass filter F1 and F2) so as to only take account of the quavering movements but not the movements intended by the firer (in the event of a moving target) whose frequencies are lower. The sensors are preferably gyrometers (angular frequency measurement).

This filtered data is amplified to drive actuators A1 and A2. The automatic control of actuators A1 and A2 will be carried out such that the frequency instructions (filtered) emitted by sensors C3 and C4 will be cancelled out.

Another solution can be envisaged to optimize the filtering and automatic control of the barrel which consists in combining two series of sensors:

- sensors C3 and C4 (or other sensors) also emit barrel position data with respect to the body of the weapon. This solution in particular avoids the barrel abutting.
- angular frequency measurement sensors C1 and C2 are mounted on the body of the weapon and position sensors are mounted between the body of the weapon and the barrel (C3 and C4).

The weapon 1 can be fitted with a sighting and rangefinding device 26 which is advantageously carried by the barrel 5 by means of an arm 27 which passes through an opening 28 made in the tubular element 17.

The angular parasitic movements of the weapon can reach 3 mrd under normal combat conditions. However, to reach an acceptable target hit probability, notably in shot by shot fire, it is thus necessary to be able to offset amplitudes which are greater than 3 mrd and to attain a residual of around 0.5 mrd, as a result the amplitude of linear movement of the actuators is around one millimeter.

Generally speaking, firing can be mechanical, since the automatic control is permanently active, a stabilizing residual remains nevertheless which is greater than the accuracy of the sensors (C1, C2, C3, C4 depending on the solution) due to the imperfections of automatic control (inertia, friction, . . . ). But, by adopting electric ignition, the direct use of sensor data enables firing to be triggered (electric firing command) at the best moment (firing window) providing better accuracy than with mechanical ignition.

Figure 3:
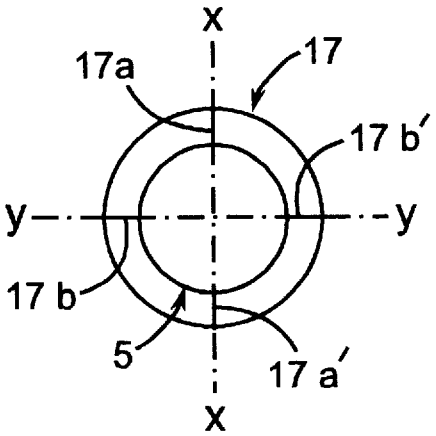

FIG. 3 represents a variant of the hinged linking means 14 mounted between the barrel 5 and the tubular element 17. These means 14 are formed by four wire assemblies 17*a*, 17*b* working by elastic torsion. One end of each wire assembly 17*a* is fastened to the inner wall of the tubular element 17, whereas the other end is fastened to the outer wall of the barrel 5. In more precise terms, two wire assemblies 17*a,* 17'*a* are respectively located on either side of the barrel 5 in line with the pivotal axis X—X. In a similar manner, the other two wire assemblies 17*b,* 17'*b* are respectively located on either side of the barrel 5 in line with the pivotal axis Y—Y.

Figure 5:
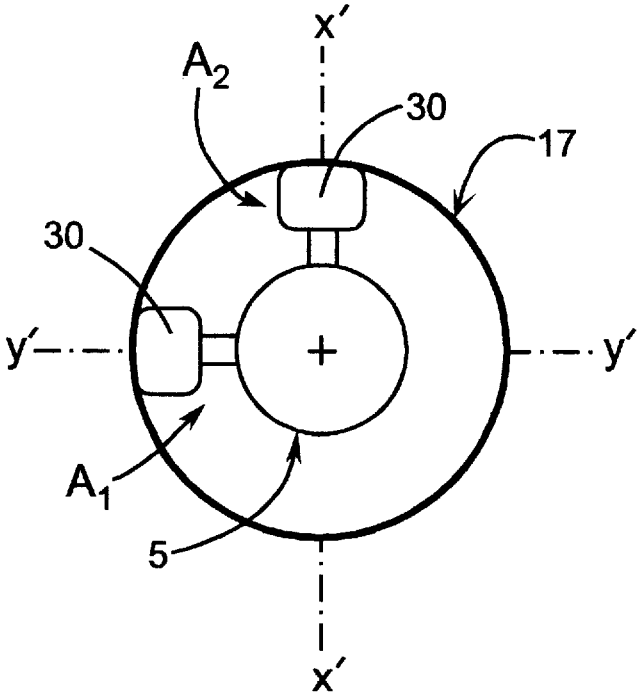

FIG. 5 shows a variant embodiment of actuators A1 and A2. Each actuator is formed by an actuating drive 30, whose body is carried by the inner wall of the tubular element 17 and whose rod is mounted hinged onto the outer wall of the barrel 5.

As a variant, actuators A1 and A2 could be made of electromagnets or piezoelectric devices.

I claim:

1. A stabilizing device for a small hand-held firearm having a sighting device, said stabilizing device comprising:

means for uncoupling a barrel with respect to the shooter, means for hinged linking which are mounted between the barrel and the means for uncoupling to enable the barrel to swivel with respect to the means for uncoupling; and means for controlling the swivel of the barrel to offset parasitic movements imparted to the firearm by the shooter during sighting by holding the barrel in the line of sight fixed by the shooter.

2. A stabilizing device according to claim 1, wherein the means for uncoupling the barrel with respect to the shooter is formed by a tubular element which is coaxially located around the barrel and is integral with a body of the firearm held by the shooter.

3. A stabilizing means according to claim 2, wherein the means for hinged linking mounted between the means for uncoupling and the barrel comprise two pivotal axes which are perpendicular to one another and onto which the barrel is mounted for swivelling about the two pivotal axes.

4. A stabilizing device according to claim 3, wherein the means for hinged linking mounted between the means for uncoupling and the barrel, are formed by four wire assemblies working by elastic torsion, two wire assemblies being located respectively on either side of the barrel and in line with one of the pivotal axes of the barrel, and the two other wire assemblies being located on either side of the barrel and in line with the other pivotal axis of the barrel.

5. A stabilizing device according to claim 1 wherein the sighting device is supported by the barrel, and is stabilized with the barrel.

6. A stabilizing device for a small firearm having a sighting device comprising:

means for uncoupling a barrel with respect to a shooter;

means for hinged linking being mounted between said barrel and said means for uncoupling to enable said barrel to swivel with respect to said means for uncoupling:

means for controlling the swivel of said barrel to offset parasitic movements imparted by the shooter, said means being a servo system; wherein control electronics emit firearm control signals from instructions supplied by sensors which are integral with a body of the firearm, to permit said sensors to detect parasitic angular movements of the firearm around the pivotal axes of the barrel, actuators driven by signals emitted from the control electronics make the barrel swivel to offset parasitic angular movements of the firearm, and sensors carried by the barrel and emit signals corresponding to at least one of the actual position and frequency of movement of the barrel and are transmitted to the control electronics to enable the control signals transmitted to the actuators to be monitored and keep the barrel in line with the line of sight fixed by the shooter.

7. A stabilizing device according to claim 6, wherein the actuators are located towards the front part of the barrel and are respectively in line with a pair of axes of the barrel.

8. A stabilizing device according to claim 7, wherein each actuator is formed by a torque motor which drives a cam resting on the barrel, and by an elastic return means opposed to the cam to keep the barrel in line with a target.

9. A stabilizing device according to claim 7, wherein each actuator is formed by an actuating drive.

10. A stabilizing device according to claim 7 wherein each actuator is formed by a back-geared motor which drives a cam resting on the barrel and by an elastic return opposed to the cam to keep the barrel in line with a target.

11. A stabilizing device for a small firearm having a sighting device comprising:

means for uncoupling a barrel with respect to a shooter;

means for hinged linking mounted between a barrel and the means for uncoupling, said means for hinged linking comprising two pivotal axes that are perpendicular to each other and onto which the barrel is swivellingly mounted and four wire assemblies using elastic torsion wherein two wire assemblies are located respectively on either side of the barrel and in line with one of the pivotal axes of the barrel and the other two wire assemblies are located on either side of the barrel and in line with the other pivotal axis of the barrel; and means for controlling the swivel of the barrel to offset parasitic movements imparted by the shooter.

* * * * *